United States Patent [19]

Potier

[11] Patent Number: 4,682,650

[45] Date of Patent: Jul. 28, 1987

[54] HEAT EXCHANGER OF THE TUBE BANK TYPE, IN PARTICULAR FOR AN AUTOMOTIVE VEHICLE

[75] Inventor: Michel Potier, Rambouillet, France

[73] Assignee: Valeo, Paris, France

[21] Appl. No.: 774,996

[22] Filed: Sep. 11, 1985

[30] Foreign Application Priority Data

Sep. 25, 1984 [FR] France ..... 84 14723

[51] Int. Cl.[4] ..... F28F 9/02

[52] U.S. Cl. ..... 165/173; 165/76; 29/157.3 C

[58] Field of Search ..... 165/173, 175, 76; 237/12.3 B, 12.3 A, 12.3 R; 29/157.3 C

[56] References Cited

U.S. PATENT DOCUMENTS 691,907 1/1902 Keeler et al. ..... 165/173
2,573,161 10/1951 Tadewald .
4,458,749 7/1984 Melnyk .

FOREIGN PATENT DOCUMENTS 0076724 9/1982 European Pat. Off. .
2303261 3/1976 France .
550630 1/1943 United Kingdom .
2122928 1/1984 United Kingdom .

*Primary Examiner*—Henry A. Bennet
*Attorney, Agent, or Firm*—Dennison, Meserole, Pollack & Scheiner

[57] ABSTRACT

In a tube-bank heat exchanger which is primarily intended for use in automotive vehicles and comprises tube sheets or headers provided with holes for mounting the tube ends in a fluid-tight manner, predetermined tubes are provided at each end with a flared-out end portion located externally of each header while other predetermined tubes are provided at each end with an annular bulge located internally of each header in order to ensure that the headers are maintained in rigidly fixed relation, thus preventing any displacement with respect to the longitudinal axis of the tubes.

8 Claims, 1 Drawing Figure

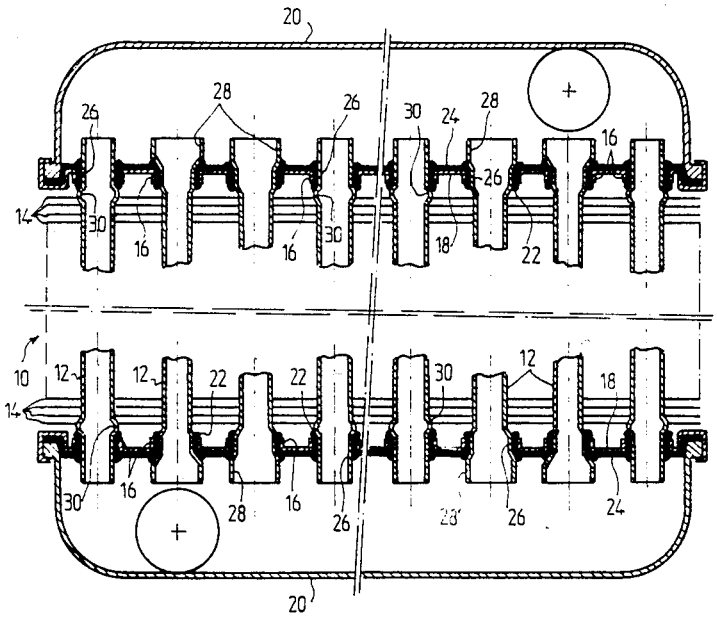
20
28
26
26
30
24
28
16
26
14
30
16
16
30
18
22
10
12
12
22
22
30
12
18
14
30
16
28
16
26
23
26
24
20

HEAT EXCHANGER OF THE TUBE BANK TYPE, IN PARTICULAR FOR AN AUTOMOTIVE VEHICLE

BACKGROUND OF THE INVENTION

1. Field of the Invention

The invention relates to a heat exchanger of the tube bank type, in particular for automotive vehicles or automobiles, in which the tube ends are mounted in fluid-tight manner within the holes of a header or a tube sheet.

2. Description of the Prior Art

In heat exchangers of this type, the tube ends are usually flared outwards from the header in order to form an abutment shoulder for retaining the tubes within the holes of the header in a predetermined direction of displacement of the header along the longitudinal axis of the tubes corresponding to detachment of the header under the action of the internal pressure which prevails within the heat exchanger under service conditions.

This mode of assembly of the tubes within the headers therefore makes it possible to maintain the header on the tubes in a predetermined direction with respect to the longitudinal axis of the tubes, the header being maintained in the opposite direction by applying the tubes of the tube bank against the fins.

As a general rule, the tubes are fitted with flat and parallel fins through which the tubes pass at right angles, said fins being secured to said tubes by crimping, for example. During assembly of the heat exchanger, the header is applied against the end fins of the tube bank, thus producing compression of the fins which are then in contact with each other at the end of the tube bank. As a result of this compression of the end fins of the tube bank, it is difficult to obtain an accurately defined spatial interval between the two headers. This is liable to have an adverse effect on the operations which consist in mounting and attaching the heat exchanger within the engine of an automotive vehicle since the headers and/or the water boxes mounted on these headers are often provided with locating studs or means for engaging or fastening the heat exchanger on a stationary chassis or frame.

Furthermore, fins which have been compressed against each other at the ends of the tube bank no longer serve any useful purpose from the point of view of heat exchange between the fluid which circulates within the heat exchanger and the fluid which flows through the tube bank and sweeps the tube fins.

SUMMARY OF THE INVENTION

The primary aim of the present invention is to circumvent the aforementioned disadvantages of the technique which has been employed up to the present time.

Accordingly, the invention proposes a tube-bank heat exchanger, in particular for an automotive vehicle, in which the tube ends are mounted in fluid-tight manner in the holes of a header or tube sheet, tube ends located outside the header being flared-out so as to form an abutment shoulder for retaining the tubes within the holes of the header in a predetermined direction with respect to the longitudinal axis of the tubes. The distinctive feature of the invention lies in the fact that predetermined tubes are not provided with a flared-out portion at the end located outside the header but are provided with a bulge applied against the header. Said bulges and said flared-out tube ends are located respectively on each side of the header and prevent any displacement of said header with respect to said tubes in either one direction or the other.

Thus in accordance with the invention, the bulges formed on predetermined tubes on one side of the header and the flared-out ends of the other tubes on the other side of the header ensure that this latter is effectively maintained in position with respect to the tubes in both directions along the longitudinal axis of said tubes. The result thereby achieved is that the header does not need to bear on the end fins of the tube bank.

An accurate spatial interval or distance between the two headers is thus guaranteed and compression of the end fins of the tube bank is prevented.

According to another distinctive feature of the invention, those tubes which are provided with flared-out end portions located outside the header are not provided with the bulges mentioned in the foregoing.

In accordance with the invention, a tube having a flared-out end portion does not in fact need to be provided in addition with an annular bulge of the above-mentioned type, only one of these two means being provided on each tube of the bank.

Furthermore, practical tests have demonstrated the fact that the end portion of only one out of approximately four tubes in the tube bank need be provided with a bulge of the type mentioned in the foregoing.

BRIEF DESCRIPTION OF THE DRAWINGS

Other features of the invention will be more apparent to those skilled in the art upon consideration of the following description, reference being made to the single accompanying FIGURE which is a partial longitudinal sectional view of a heat exchanger in accordance with the invention.

DETAILED DESCRIPTION OF THE INVENTION

The heat exchanger illustrated in the drawing comprises a bank 10 of straight and parallel tubes 12 which are arranged for example in rows and in columns. The tubes 12 are fitted with flat and parallel fins 14 through which said tubes are passed at right angles, the fins being secured to the tubes by a suitable method such as crimping, for example. The ends of the tubes 12 are not provided with fins and are engaged in a fluid-tight manner within cylindrical collars 16 which surround the holes formed in headers 18 or tube sheets, water boxes 20 being fixed on said headers in the conventional manner.

Fluid-tight fitting of the tube ends within the holes of the headers 18 is ensured by means of seals formed by tubular bushings or sleeves 22 of a sheet 24 of elastomer which covers the outer face of each header 18, namely the face located externally with respect to the tube bank 10 and within the corresponding water box 20. The cylindrical collars 16 of the header are oriented towards the interior of the tube bank 10 or in other words away from the corresponding water box 20.

The tube ends (tubes 12) which are introduced into the tubular sleeves 22 of elastomer sheets 24, said sleeves being in turn introduced into the cylindrical collars 16 of the headers, are expanded radially at the level of the collars 16 as shown at 26 in order to produce compression of the elastomer sleeves 22 against the cylindrical collars 16 of the headers.

Moreover, the ends of predetermined tubes 12 of the tube bank, namely the tube ends which are located outside the headers 18 and thus project into the interior of each water box 20, are subjected to a further radial expansion in order to form a flared-out portion 28 for locking said tubes in position with respect to the headers 18. Said flared-out portions 28 prevent any withdrawal of the tube ends from the holes or cylindrical collars 16 of the headers.

The other tubes 12 of the tube bank which do not have flared-out portions 28 are formed with an annular bulge 30 which is applied against the end of the cylindrical collar 16 of the header through the intermediary of the end portion of the elastomer sleeve 22. Said annular bulges 30 prevent any displacement of a header 18 towards the other header with respect to the tubes 12.

As is clearly apparent from the drawing, the headers 18 do not bear on the end fins 14 of the tube bank 10, with the result that said end fins 14 remain in parallel and spaced relation to each other.

At the time of assembly of the heat exchanger, the radial expansion operations for forming the flared ends 28 and the annular bulges 30 of the tubes 12 are carried out simultaneously by a single machine.

The assembly of tubes 12 within the holes or cylindrical collars 16 of the headers 18 as performed in accordance with the invention accordingly offers a guarantee that the headers are accurately and securely maintained in position on the tubes, that the distance between headers is maintained at a predetermined value, that the fins are in no way liable to be compressed against each other at the ends of the tube bank 10, and finally that the reject rate is reduced, rejects being constituted by tubes having split tube ends as a result of the end-expansion or flaring-out operation.

As mentioned earlier, it is only necessary to ensure that approximately 75% of the tubes 12 of the bank are formed with flared ends 28 whilst the remaining 25% of the tubes are formed with annular bulges 30.

The invention is also applicable to other types of heat exchanger such as, for example, hairpin-tube or U-tube heat exchangers and those in which the tubes are provided with elements folded in bellows-type pleats and inserted between the tubes for heat exchange with the external fluid.

What is claimed is:

1. A tube-bank heat exchanger, in particular for an automotive vehicle, including a pair of headers with multiple tubes therebetween, said tubes having substantially coextensive first ends and substantially coextensive second ends, said headers having multiple holes defined therethrough, the first and second tube ends being received through and extending beyond the corresponding headers and being mounted in a fluid-tight manner in the holes of the headers, the first and second ends of each tube being substantially identical, selected ones of said tubes having their tube ends outwardly enlarged solely beyond the corresponding headers and defining abutment shoulders retaining the selected tubes within the holes of the headers against outward withdrawal of the headers therefrom, the remainder of said tubes being outwardly enlarged solely inward of the hole-received ends thereof and inward of the corresponding headers to define bulges retaining the headers against inward movement of said headers relative to the tubes, said bulges and said abutment shoulders being located immediately adjacent the opposed sides of the corresponding headers and preventing any displacement of said headers with respect to said tubes.

2. A tube-bank heat exchanger, in particular for an automotive vehicle, including multiple tubes having first substantially coextensive tube ends and second substantially coextensive tube ends, and header means for mounting said first and second tube ends, said header means having multiple holes defined therethrough, the tube ends being received through and extending beyond said header means, and being mounted in a fluid-tight manner in the holes of the header means, selected ones of said tube ends being outwardly enlarged solely beyond said header means and defining abutment shoulders retaining the selected tubes within the holes of the header means against outward withdrawal of the header means therefrom, the remainder of said tube ends being outwardly enlarged solely inward of the header means to define bulges retaining the header means against inward movement of said header means relative to the tubes, said bulges and said abutment shoulders being located immediately adjacent the opposed sides of the header means and preventing any displacement of said header means with respect to said tubes.

3. A heat exchanger according to claim 1, wherein said selected ones of said tubes comprise approximately three tubes out of four in the tube bank.

4. A heat exchanger according to claim 1, wherein the holes of the headers are surrounded by cylindrical collars with tubular seals interposed between the tube ends and the collars, and between the annular bulges and said cylindrical collars.

5. A heat exchanger according to claim 4 wherein said tubular seals comprise sleeves formed in a sheet of elastomer or the like which covers the header face located externally of the tube bank, the tube ends which are received through the holes of the header extending through the sleeves of said elastomer sheet and being subjected to radial expansion, the sleeves of said elastomer sheet being thus applied under pressure against the internal surfaces of the cylindrical collars of said header.

6. A heat exchanger according to claim 1, including parallel fins mounted on and transversely across the tubes between the end portions thereof, the end fins adjacent to the header maintaining parallel relation and being spaced at a distance from each other and from said header after assembly of said heat exchanger.

7. A heat exchanger according to claim 1, wherein the distance between the headers is equal to a predetermined value.

8. A heat exchanger according to claim 2, wherein the header means of the tube bank comprises a header at each end thereof, the substantially coextensive first tube ends being received through one header, and the substantially coextensive second ends being received through the other header, the first and second ends of each tube being designed in an identical manner, either with an end portion which is flared-out beyond the corresponding header or with an annular bulge inward of the corresponding header.

* * * * *